US007836976B2

(12) United States Patent
Preston et al.

(10) Patent No.: US 7,836,976 B2
(45) Date of Patent: Nov. 23, 2010

(54) UNDERGROUND PIERCING TOOL

(75) Inventors: Duane Preston, Mentor, OH (US); Michael Grabnic, Walton Hills, OH (US); Dan Marsalek, Toledo, OH (US)

(73) Assignee: Allied Construction Products, L.L.C., Cleveland, OH (US)

( * ) Notice: Subject to any disclaimer, the term of this patent is extended or adjusted under 35 U.S.C. 154(b) by 283 days.

(21) Appl. No.: 11/732,967

(22) Filed: Apr. 5, 2007

(65) Prior Publication Data

US 2007/0175646 A1 Aug. 2, 2007

(30) Foreign Application Priority Data

Oct. 20, 2005 (WO) ..... PCT/US2005/038123

(51) Int. Cl.
*E21B 4/14* (2006.01)

(52) U.S. Cl. ..... 175/296; 175/19

(58) Field of Classification Search ..... 175/19, 175/57, 293, 296, 414; 173/19, 90, 91; 285/333, 285/334, 355, 390
See application file for complete search history.

(56) References Cited

U.S. PATENT DOCUMENTS 1,830,877 A * 11/1931 Kirby ..... 137/484
1,861,042 A 5/1932 Zublin
3,108,830 A * 10/1963 Fierstine ..... 403/140
3,109,672 A * 11/1963 Franz ..... 285/334
3,399,548 A * 9/1968 Burns ..... 464/18
3,407,884 A 10/1968 Zygmunt et al.
3,474,873 A * 10/1969 Zygmunt ..... 175/19
3,865,200 A 2/1975 Schmidt
3,891,036 A * 6/1975 Schmidt ..... 173/91
4,070,948 A * 1/1978 Tkach et al. ..... 91/234
4,100,980 A * 7/1978 Jenne ..... 175/19
4,144,941 A * 3/1979 Ritter ..... 175/19
4,221,157 A * 9/1980 Schmidt ..... 91/416
4,334,795 A * 6/1982 Westphal ..... 403/131
4,366,834 A * 1/1983 Hanson et al. ..... 137/489.3
4,445,265 A * 5/1984 Olson et al. ..... 29/447
4,537,265 A * 8/1985 Cox et al. ..... 175/19
4,662,457 A 5/1987 Bouplon
4,821,813 A * 4/1989 Jenne et al. ..... 173/135
4,872,516 A * 10/1989 MacFarlane et al. ..... 173/206
4,953,626 A * 9/1990 Puttmann et al. ..... 173/91
4,958,689 A * 9/1990 Lee ..... 175/19

(Continued)

*Primary Examiner*—Shane Bomar
*Assistant Examiner*—Blake Michener
(74) *Attorney, Agent, or Firm*—Tarolli, Sundheim, Covell & Tummino LLP

(57) ABSTRACT

A pneumatically operated underground piercing tool including an elongate cylindrical body carrying an anvil and a striker slidably received within a chamber. A valve assembly controls the communication of pressurized air to and from the body and is operator adjustable in order to produce forward or rearward movement of the piercing tool. The body and an end cap are connected by a tapered buttress thread. The striker defines a plurality of balancing grooves. A recess is formed in an end wall of the striker to inhibit pressurized fluid from being trapped between the striker and the end cap when the striker is reciprocated within the body. A tail adaptor is threadedly secured to the end cap using tapered buttress thread configurations. The valve assembly includes a detent mechanism and an improved exhaust bushing. The control spool is coupled to an end of said valve support by structure which includes a spherical element held in an elastomeric socket.

30 Claims, 6 Drawing Sheets

U.S. PATENT DOCUMENTS 5,025,868 A * 6/1991 Wentworth et al. ..... 173/91
5,086,848 A 2/1992 Hudak
5,092,635 A * 3/1992 DeLange et al. ..... 285/334
5,117,922 A * 6/1992 Baron ..... 173/91
5,127,784 A * 7/1992 Eslinger ..... 411/414
5,135,025 A * 8/1992 Mackal ..... 137/541
5,148,878 A * 9/1992 Schmidt et al. ..... 175/296
5,172,771 A * 12/1992 Wilson ..... 173/1
5,311,950 A * 5/1994 Spektor ..... 175/19
5,318,135 A * 6/1994 Kayes ..... 175/19
5,327,636 A * 7/1994 Wilson ..... 29/525
5,415,442 A * 5/1995 Klementich ..... 285/331
5,465,797 A 11/1995 Wentworth et al.
5,603,383 A * 2/1997 Wentworth et al. ..... 173/91
6,467,554 B1 10/2002 Millican
6,923,270 B1 * 8/2005 Randa ..... 173/91
2002/0036406 A1 * 3/2002 Parker ..... 285/282
2004/0165963 A1 * 8/2004 Bucknell ..... 411/14.5
2006/0202475 A1 * 9/2006 Gunderson ..... 285/305

* cited by examiner

UNDERGROUND PIERCING TOOL

REFERENCE TO A PRIOR APPLICATION

This application claims the benefit of PCT/US2005/038123, filed Oct. 20, 2005 and U.S. Provisional Application No. 60/621,970, filed Oct. 25, 2004.

TECHNICAL FIELD

The present invention relates generally to underground boring and, in particular, to an improved fluid pressure operated piercing tool.

BACKGROUND ART

Pneumatically operated, underground piercing tools are commonly used to install wire, conduit and tubing under a roadway, sidewalk, etc. The use of these devices reduces the need for excavating or trenching and, hence, provide a cost effective method for installing utility lines, cable, etc. in developed areas. This type of tool eliminates the need for excavating through hard landscape items that obstruct the path of the line or conduit being installed. An example of this type of piercing tool is fully disclosed in U.S. Pat. No. 4,662,457 which is hereby incorporated by reference. As fully explained in that patent, a striker mechanism which is operated by pressurized air, either repeatedly impacts an anvil mounted at the nose of the tool in order to move the tool forwardly, or repeatedly impacts an abutment located at the rear of the tool in order to move the piercing tool rearwardly, i.e., to withdraw the tool from the bore hole. U.S. Pat. Nos. 3,865,200 and 5,465,797 illustrate other examples of piercing tools that have other types of striking elements i.e. percussion tips located at a forward end of the tool.

The piercing tool disclosed in the '457 patent has enjoyed commercial success. However, it has become desirable to improve the reliability and life of these types of tools, and to reduce and simplify maintenance. In the type of tool to which this invention pertains, the various components that make up the tool assembly are connected together using threaded connections. The threaded connections facilitate both assembly during the manufacture of the tool and facilitate disassembly when the tool requires maintenance. It has been found, however, that these threaded connections can be a source of failure during operation of the tool. These threaded connections experience substantial impact loads as the internal striker repeatedly strikes either the anvil or the rear abutment. These failures can be further precipitated by operating the tool at higher than recommended air pressures and/or operating the tool outside its intended parameters.

It is, therefore, desirable to provide a tool of this type that can be manufactured at reduced cost, but with improved reliability while at the same time facilitating its maintenance and repair.

DISCLOSURE OF INVENTION

The present invention provides a new and improved underground piercing tool assembly that includes strengthened component interconnections while facilitating disassembly of the tool in order to perform maintenance and repair.

In the preferred and illustrated embodiment, a fluid pressure operated underground piercing tool is disclosed that includes an elongate cylindrical body that carries an anvil at one end. A striker is slidably received in a chamber defined by the cylindrical body. An end cap is threadedly received by another end of the body, such that the end cap captures the striker within the body chamber. A valve assembly for controlling the communication of pressurized fluid, i.e., pressurized air, to the body is provided that is operator adjustable in order to produce forward or rearward movement of the underground piercing tool. In accordance with the invention, the threaded engagement between the cylindrical body and the end cap is of a tapered thread configuration. In a more preferred embodiment, the threaded engagement is provided by tapered buttress threads formed on the cylindrical body and end cap.

In a more preferred embodiment, a female tapered thread is formed on the other end of the cylindrical body whereas a complementally configured male tapered thread is formed on the end cap.

According to a feature of the invention, the striker may define a plurality of balancing grooves which aid in the uniform distribution of pressurized fluid, i.e., air around the striker. According to another feature of the invention, an end wall of the striker may define at least one recess which inhibits pressurized fluid from being trapped between the striker and the end cap when the striker is reciprocating within the body.

According to another feature of the invention, the striker defines at least one radial port that is oblong or slot-like in shape. In the preferred configuration, a long dimension of the port is parallel to an axis or a centerline of the striker. With this configuration, a strengthened region of the striker where the port is defined is provided without sacrificing port area.

According to another feature of the invention, the piercing tool may include a tail adaptor that is coupled to the end cap using tapered thread configurations formed on the end cap and tail adaptor. According to still another feature of the invention, an exhaust bushing which supports the valve assembly in its operative position is received by the end cap and secured in its operative position by the tail adaptor. In accordance with this feature of the invention, the thread configurations formed on the tail adaptor end cap are complementally formed tapered buttress threads.

Additional features of the invention will become apparent and a fuller understanding obtained by reading the following detailed description made in connection with the accompanying drawings.

BEST MODE FOR CARRYING OUT THE INVENTION

Figures 1, 1A:
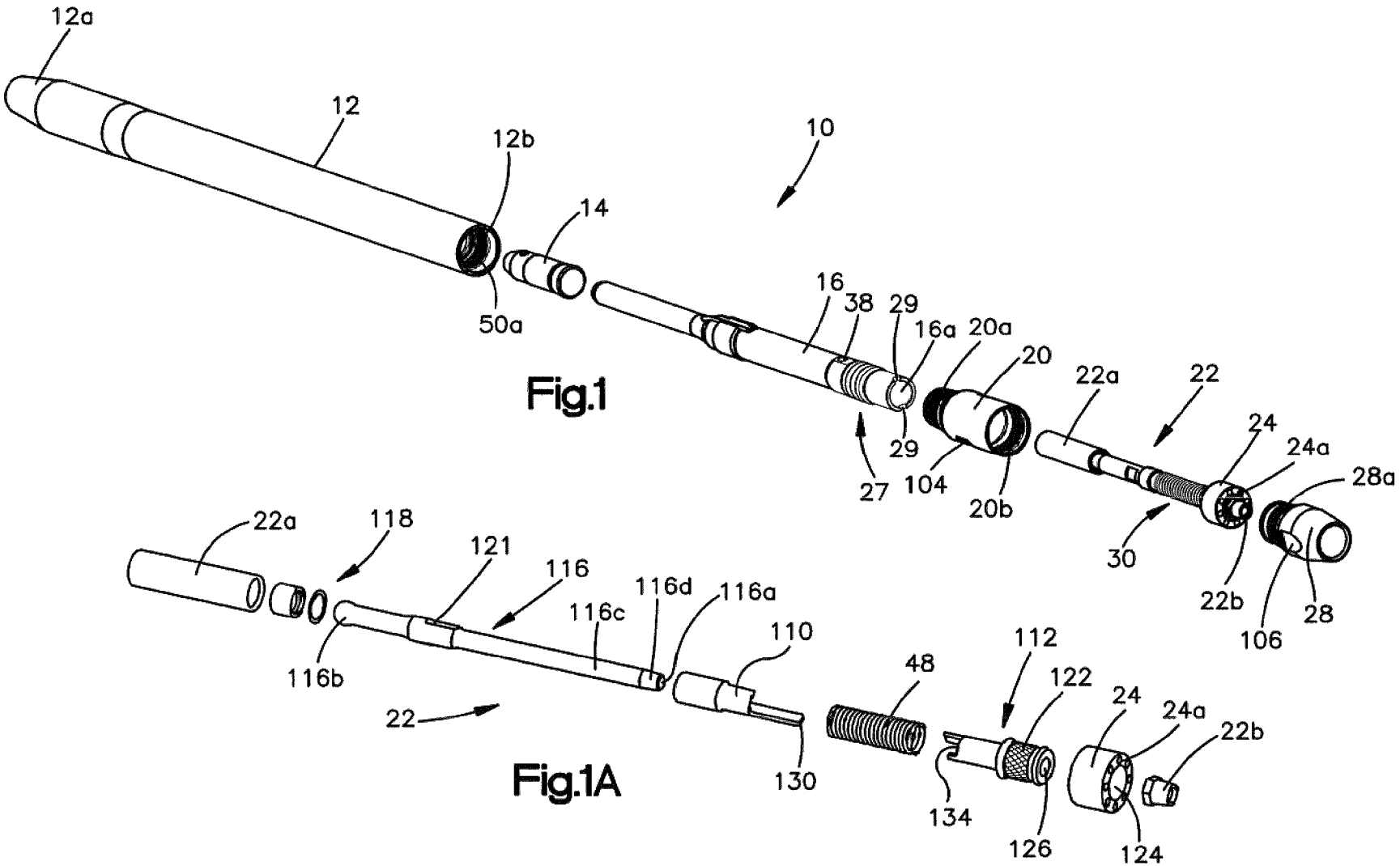
FIG. 1 is an exploded view of a piercing tool constructed in accordance with the preferred embodiment of the invention.
FIG. 1A is an exploded view of a valve assembly forming part of the tool shown in FIG. 1.

FIG. 1 is an exploded view of an underground piercing tool 10 constructed in accordance with a preferred embodiment of the invention. The piercing tool 10 includes an elongate, cylindrically shaped, hollow body 12 having a tapered nose 12*a*. An anvil 14 is pressed into the nose 12*a* of the body 12 using known pressing methods. When pressed in position, a portion of the anvil 14 extends forwardly of the nose 12*a*.

Figure 7:
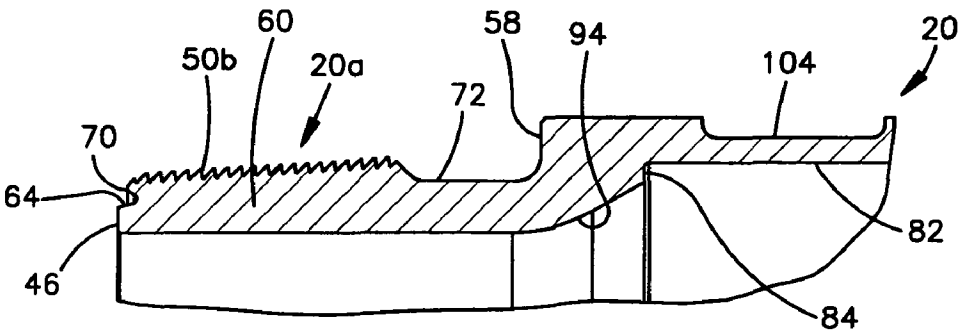
FIG. 7 is an enlarged fragmentary, sectional view of the end cap shown in FIG. 6.

A striker 16 is reciprocally movable within the body 12 and is captured within the body 12 by an end cap 20 having an externally threaded segment 20*a* that is threadedly received by an internally threaded body section 12*b*. The threaded segment 20*a* is preferably tapered as best seen in FIG. 7. In operation, and as is conventional, the striker 16 either repeatedly strikes the anvil 14 in order to move the piercing tool 10 forward or repeatedly strikes the end cap 20 to move the piercing tool 10 in a reverse direction.

Figure 2:
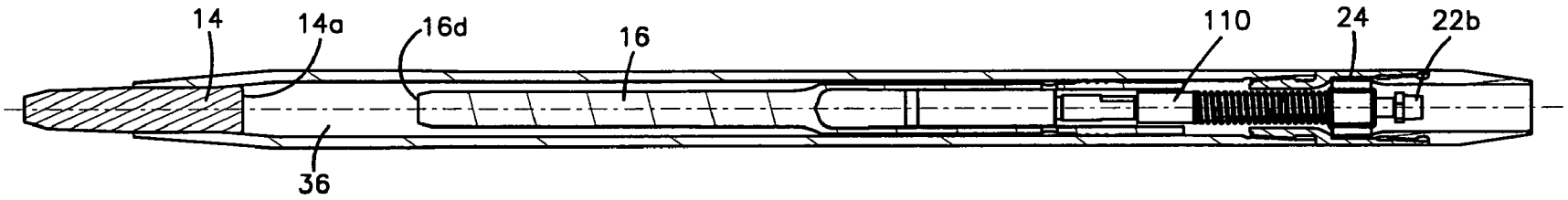
FIG. 2 is a sectional view of the piercing tool shown in FIG. 1.
Figure 3:
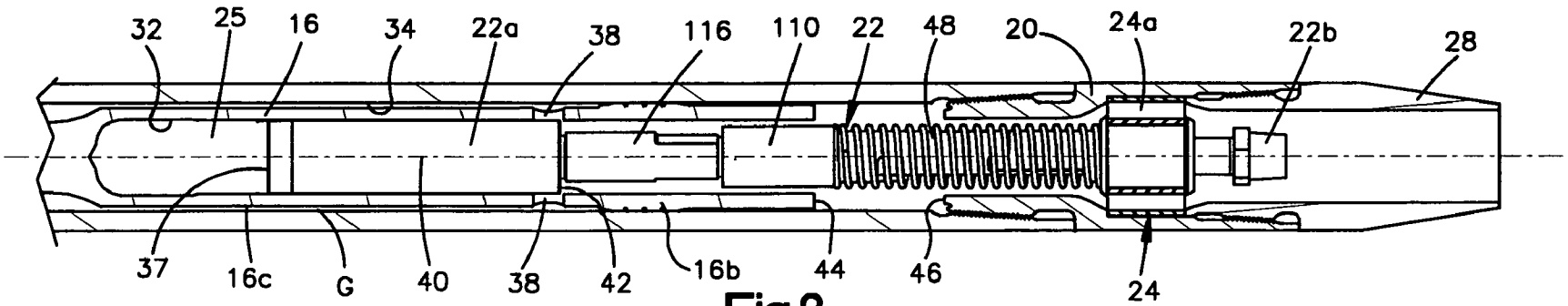
FIG. 3 is an enlarged, fragmentary sectional view of the piercing tool shown in FIG. 2.

A valve assembly 22 including a control spool 22*a* is used to control the direction of movement of the piercing tool 10. When assembled, the spool 22*a* extends into and is received by a bore 32 defined by the striker 16. Referring also to FIGS. 2 and 3, the valve assembly 22 carries a bushing 24 at its rear end that includes a plurality of air flow passages 24*a* (shown best in FIG. 3). As is conventional, movement in the striker 16 is produced by the application of air pressure. In particular and as will be explained, the valve assembly 22 is connected a supply hose or conduit 26 shown in FIGS. 10A-C. The supply hose 26 delivers air under pressure from an air pressure source (not shown) to the valve assembly 22. Ultimately the pressurized air is communicated to a striker pressure chamber or cavity 25 and elsewhere and depending on the mode of operation, causes the striker 16 to move the piercing tool forward by repeatedly striking the anvil 14 or producing reverse movement in the piercing tool 10 by repeatedly striking the end cap 20.

According to a feature of the invention, the striker includes a plurality of balancing grooves 27. The grooves aid in the uniform distribution of air around the striker 16 and it is believed will tend to center the striker 16 within the body 12, i.e. maintain a more uniform radial clearance between the striker 16 and the body 12. In addition, the grooves 27 tend to more uniformly distribute lubrication around the striker. In general, lubrication, i.e., oil is entrained in the air supply and is delivered along with the air to the boring tool.

According to another feature of the invention, a pair of arcuate recesses 29 are formed on a right end wall (as viewed in FIG. 1) of the striker 16. The recesses 29 prevent air from being trapped between the striker 16 and the end cap 20 as the striker reciprocates within the tool body 12. Without these recesses 29, any trapped air would hinder movement of the striker 16 and reduce performance of the tool.

As will be explained, the mode of operation for the piercing tool, i.e., whether it is moving forwardly or rearwardly is determined by the positioning of the valve spool 22*a* within the body 12. The right end (as viewed if FIG. 1) of the valve assembly 22 is secured within the end cap 20 by a tail adaptor 28. In particular, the bushing 24 is suitably secured to the right end of the valve assembly 22. As will be detailed below, the bushing 24 is captured between the end cap 20 and the tail adaptor 28 which includes an externally threaded segment 28*a* that is threadedly received by an internally threaded segment 20*b* defined by the end cap 20. The valve assembly 22 includes a detent mechanism, indicated generally by the reference character 30, which determines the distance to which the spool 22*a* extends into the tool body 12 and, hence, the operational mode (i.e., forward or reverse) of the piercing tool 10.

The overall operation of a piercing tool of the type disclosed in FIG. 1, is fully explained in U.S. Pat. No. 4,662,457 which is hereby incorporated by reference. Referring to FIGS. 2 and 3, the longitudinal position of the valve spool 22*a*, within the tool body 12, determines the direction of movement for the piercing tool 10. As seen best in FIG. 3, the spool 22*a* is slidably received within the blind bore 32 defined by the striker 16. The pressure chamber 25 is defined by the blind end of the bore 32 and an end face 37 of the control spool 22*a*.

As seen best in FIG. 3, a rear portion of the striker 16 includes a larger diameter portion 16*b* near its right end (as viewed in FIG. 3) that sealingly engages a cylindrical bore 34 defined by the body 12. The diameter of the striker portion 16*c* to the left of the sealing region 16*b* has a reduced diameter and defines a gap G between the outside of the striker portion 16*c* and the inside bore 34 of the body 12. The gap G forms a passage which enables air to flow around the striker 16 and into a reverse pressure chamber 36 defined by the left end (as viewed in FIG. 2) of the body bore 34 and the forward end of the striker 16. As should be apparent, when air pressure is communicated to the chamber 36, it creates a force on the striker 16 urging it away from the anvil 14.

Referring, in particular, to FIG. 3, the valve spool 22*a* is shown in a position in which it produces forward motion in the piercing tool, i.e., in a position at which it causes the striker 16 to repeatedly strike the anvil 14 to generate an impact force that tends to move the piercing tool towards the left as viewed in FIG. 2. In the position shown in FIG. 3, air pressure in the front chamber 36 is being exhausted via the gap G and a plurality of radial ports 38 formed in the striker 16. In particular, the air pressure in the chamber 36 travels through the radial ports 38 and is exhausted out the rear of the piercing tool via the exhaust passages 24*a* formed in the bushing 24.

In the preferred and illustrated embodiment, and referring also to FIG. 1, two radial ports 38 are formed in the striker 16 and are oblong or slot-like in shape. In the illustrated construction, the long dimension of the slot is parallel to an axis or centerline 40 (shown in FIG. 3). With this preferred construction, the cross sectional area of the port is increased over that of a port that is circular and this increased cross section area is obtained without weakening the striker wall in the vicinity of the ports as is the case with strikers that utilize three or more circular ports that define a total port cross section that is equal to the port cross section defined by the elongate ports 38 of the present invention. It was found in the prior art that the port area on the striker is susceptible to failure, since the material removed to form the ports weakens the wall of the striker in the vicinity of the ports.

Figure 4:
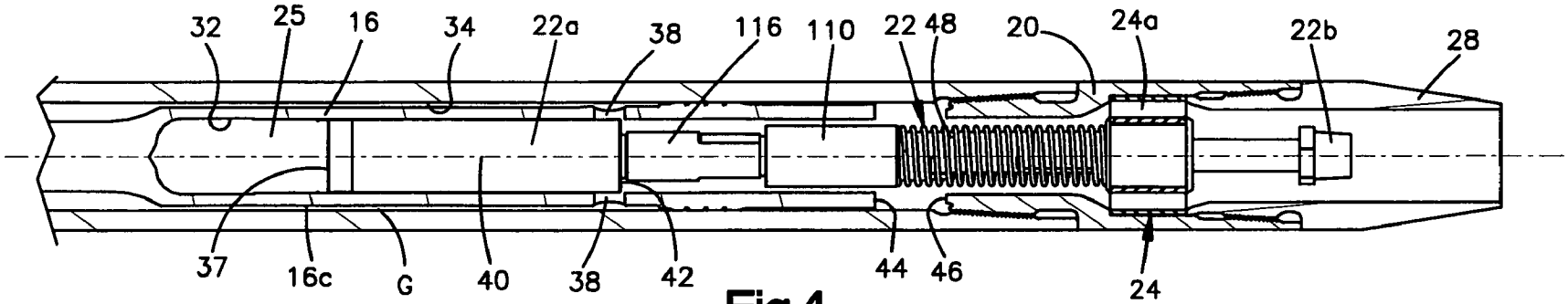
FIG. 4 is another fragmentary, sectional view of the piercing tool shown in FIG. 2 with certain components shown in alternate positions.

During tool operation, air under pressure is at all times communicated to the chamber 25 via a central passage 116*a* (shown in FIG. 1A) defined in the valve assembly 22 (shown in FIG. 4). In the preferred embodiment, the passage is coextensive with the centerline 40 of the valve assembly 22. Air communicated to the chamber 25 urges the striker 16 towards the left as view in FIG. 3 i.e., towards the anvil 14. Ultimately, a front surface 16*d* of the striker 16 strikes a base surface 14*a* of the anvil 14 with a significant impact force which urges the overall piercing tool 10 towards the left as viewed in FIG. 2. During leftward movement of the striker 16, the radial ports travel along the outer surface of the valve spool 22*a*.

With the valve spool 22*a* in the position shown in FIG. 3, as the striker 16 impacts (or just before the striker impacts the anvil 14), the radial ports 38 move beyond the front end face 37 of the control spool 22*a* and, hence, communicate the pressure chamber 25 with the gap G. In this position, air pressure in the chamber 25 is communicated to the chamber 36 thus creating a force on the striker 16 in opposition to the force created by the air pressure in the chamber 25. The cavity/bore 32 is sized such that an internal effective pressure area defined by the chamber 25 is less than the effective pressure area defined by the front end of the striker 16 so that a net reversing force is created on the striker 16 tending to move the striker rearwardly, i.e., towards the right as view in FIG. 3.

By the proper positioning of the control spool 22*a* and the radial ports 38, the net reversing force is generated on the striker just before or just after the striker 16 strikes the anvil 14. The pressure in the front chamber 36 causes the striker 16 to move rearwardly until the radial ports 38 move past a rear edge 42 of the spool 22*a* (this position is shown in FIG. 3) so that the pressurized air in the front chamber 36 can be exhausted through the bushing 24, thus depressurizing the front chamber 36 and causing the striker 16 to reverse direction due to the pressure in the chamber 25 which is now substantially unopposed by a reduced pressure in the front chamber 36. As should be apparent, with the valve spool 22*a* in the position shown, a reciprocating motion will be produced in the striker 16 which will cause the striker to repeatedly strike the anvil 14 in order to move the tool in the forward direction.

To produce reverse motion in the piercing tool 10, the control spool 22*a* is moved rightwardly as viewed in FIG. 3 to the position shown in FIG. 4 In effect, by moving the control spool 22*a* rightwardly, the position of the striker 16 at which the radial ports 38 are exposed, changes. With the valve spool 22*a* in the position shown in FIG. 4, the radial ports 38 move beyond the rear edge 42 of the valve spool 22*a* just before an end face 44 the striker 16 strikes an end surface 46 defined by the end cap 20. Conversely, the radial ports 38 are moved beyond the front end face 37 of the valve spool 22*a* well before the front end face 16*d* of the striker 16 impacts the anvil 14. As a consequence, when the control piston or spool 22*a* is in the position shown in FIG. 4, the striker 16 repeatedly impacts the end surface 46 of the end cap 20 in order to move the piercing tool 10 rearwardly, i.e., towards the right as viewed in FIG. 4 (and does not strike the anvil 14).

Figure 5:
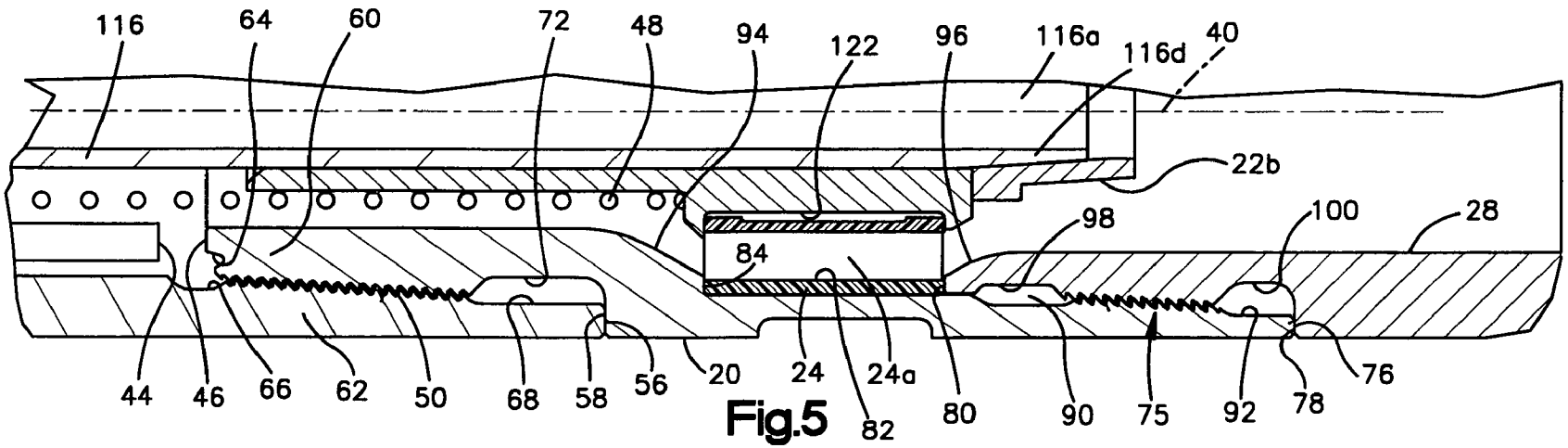
FIG. 5 is an enlarged sectional view of a portion of the piercing tool.
Figure 6:
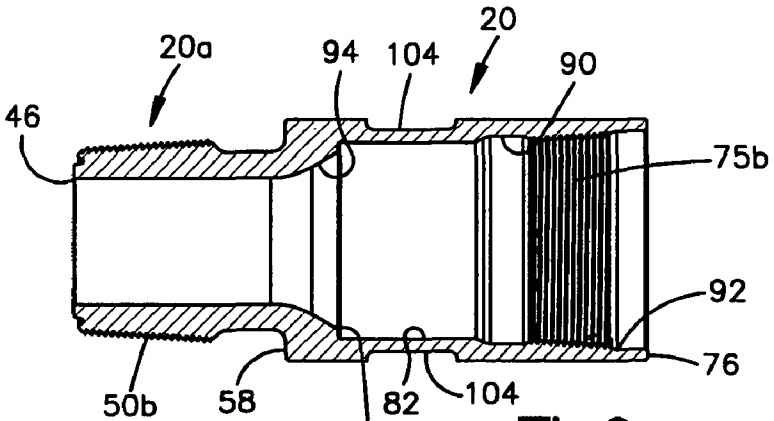
FIG. 6 is a sectional view of an end cap forming part of the piercing tool shown in FIG. 1.

Turning now to FIGS. 5-7, features of the invention are shown in detail. In the preferred embodiment, the threaded engagement between the end cap 20 and the tool body is provided by a tapered buttress thread indicated by the reference character 50 and including an internal thread segment 50*a* (shown in FIG. 1) machined into the body segment 12*b* and a mating external thread segment 50*b* machined into the end cap segment 20*a*. The thread 50 transfers the reverse, impacting force generated by the striker 16 (as it strikes the end surface 46), to the body 12. In particular, during reverse operation, a radial end face 44 of the striker 16 repeatedly strikes a radial end surface 46 defined by the end cap 20. This impact force is transferred to the body 12 via the buttress threads 50.

According to this feature of the invention, an end face 56 of the piercing tool body 12 abuttably engages a radial surface 58 defined by the end cap 20. With this construction, the impact forces are more uniformly distributed and a positive stop is defined between the end cap 20 and the body 12 when the end cap is threaded into the body. More importantly, by using a tapered thread, balanced engagement sections indicated generally by the reference characters 60, 62 are defined greatly reducing stress risers that could cause failure in the connection. In addition, a counter recess 64 is defined around the end surface 46 of the end cap 20 to further control the direction of the impact forces exerted by the striker 16 on the end cap 20. Finally relieved sections 66, 68 defined by the threaded segment of the body 12, as well as relieve sections 70, 72 defined by the end cap 20 substantially reduce stress risers. The use of the disclosed tapered thread also facilitates assembly and disassembly of the tool. In the illustrated embodiment, a 12 pitch American National Standard 7 deg./45 deg. buttress thread is illustrated which has been found to provide good performance in this type of application. The illustrated thread has a taper in the range of 1.5 inches per foot. With the disclosed construction, the end cap to body engagement is provided by 19 threads, but due to the tapered configuration, it requires only 9 turns to assemble. This greatly facilitates maintenance of the piercing tool. For other applications, a taper in the range of 0.75 inches per foot provides satisfactory results.

It should be noted that other tapers may also provide satisfactory results and are contemplated by the invention. It should also be noted that other non-buttress type thread profiles may also provide satisfactory results and are contemplated by the present invention. The invention should not be limited to the illustrated thread profile.

Figure 8:
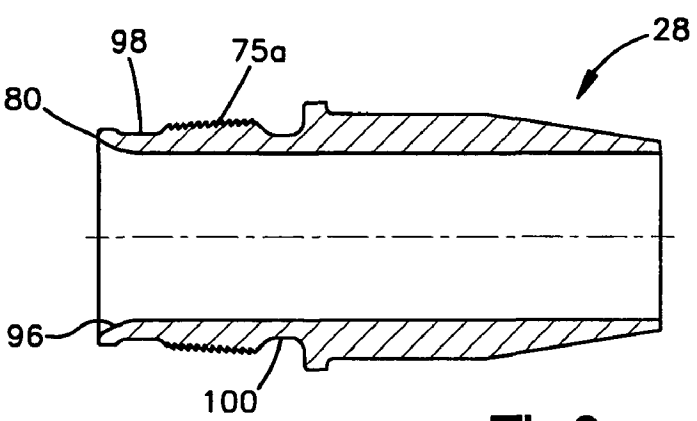
FIG. 8 is a sectional view of a tail adaptor forming part of the piercing tool.
Figure 9:
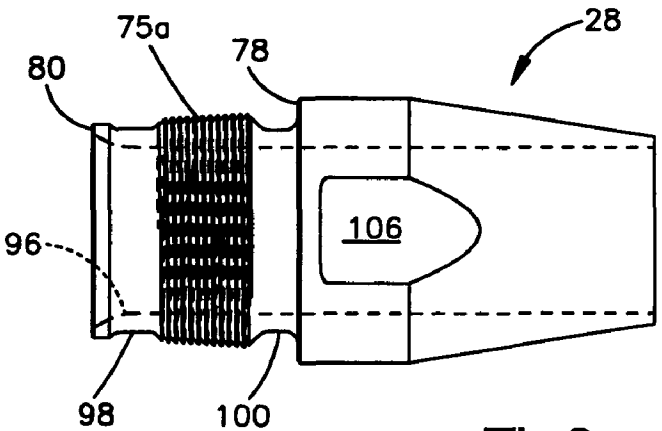
FIG. 9 is an elevational view of the tail adaptor shown in FIG. 8.

In the preferred embodiment and referring also to FIGS. 8 and 9, the tail adaptor 28 is held to the end cap 20 by a similar thread configuration. As seen in FIG. 5, a tapered buttress thread indicated generally by the reference character 75 secures the tail adaptor 28 to the end cap 20. The tail adaptor includes an external thread 75*a* and the end cap 20 includes a mating internal thread 75*b*. In this preferred embodiment, the end cap 20 defines a radial end face 76 which abuttably engages a radial surface 78 defined by the adaptor 28. This engagement provides a positive stop between the end cap 20 and tail adaptor 28; there is not an interference type thread engagement as found in the prior art.

The tail adaptor 28 includes a radial locating or clamping surface 80 which secures the exhaust bushing 24 and, hence, the valve assembly in its operative position. As seen best in FIGS. 5 and 6, the bushing 24 is received by the end cap 20 in a uniform diameter portion 82. One side of the bushing 24 abuts a radial locating surface 84 (seen best in FIG. 7) defined by the end cap 20 and is secured in the illustrated position by the tail adaptor 28 which abuts the opposite side of the bushing 24 and clamps the bushing in position between the end cap radial surface 84 and the clamping surface 80 defined by the tail adaptor 28. With the disclosed construction, maintenance of the bushing and/or valve assembly is greatly facilitated. The use of the buttress thread 75 provides a reliable engagement while allowing easy disassembly. Removal of the tail adaptor 28 allows the bushing 24 and associated valve assembly to be easily pulled from the piercing tool body 12 for maintenance or replacement.

According to another feature of the invention, curvilinear, tapered surfaces 94, 96 are provided by both the end cap 20 and tail adaptor 28, respectively for promoting smooth air flow to and through the bushing 24 and improving the flow characteristics of the air being exhausted by the tool, thus improving its efficiency.

The end cap 20 includes relieved sections 90, 92 (see FIGS. 5 and 6) on either side of the threaded segment 75*b*. Similarly, relieved areas 98, 100 are also formed on the tail adaptor 28 on either side of the threaded segment 75*a* in order to reduce stress risers. As seen best in FIGS. 6, 7 and 9, both the end cap 20 and the tail adaptor 28 include at least a pair of spaced apart flats 104, 106, respectively, that are engageable by a suitable tool such as a wrench. The flats 104, 106 facilitate the assembly and disassembly of the tool and in particular the installation and removal of the end cap 20 and tail adaptor 28.

An example of a detent mechanism 30 for adjusting the position of the valve spool 22*a* is fully illustrated and explained in U.S. Pat. No. 4,662,457. The detent mechanism of the tool shown in FIGS. 1-4 is functionally similar to the mechanism shown in the '457 patent, but differs in details. Referring to FIGS. 1A and FIGS. 10A-C, the detent mechanism 30 includes interlocking, relatively rotatable finger and guide members 110, 112 which determine the distance between the control piston or valve spool 22*a* and the bushing 24. In the illustrated embodiment, a biasing spring 48 urges the control spool 22*a* away from the bushing 24. When air pressure is not being supplied to the piercing tool 10, this biasing spring 48 moves the control spool 22*a* away from the bushing 24, i.e., to a maximum separation permitted by the detent mechanism 30 (the position shown in FIG. 10A). When air pressure is applied to the piercing tool, the pressure in the chamber 25 exerts a force on the front face 37 of the control spool 22*a* moving it towards the bushing 24 until the finger and guide members 110, 112 of the detent mechanism 30 engage and prevent further rearward movement in the control spool 22*a*.

Figure 10A:
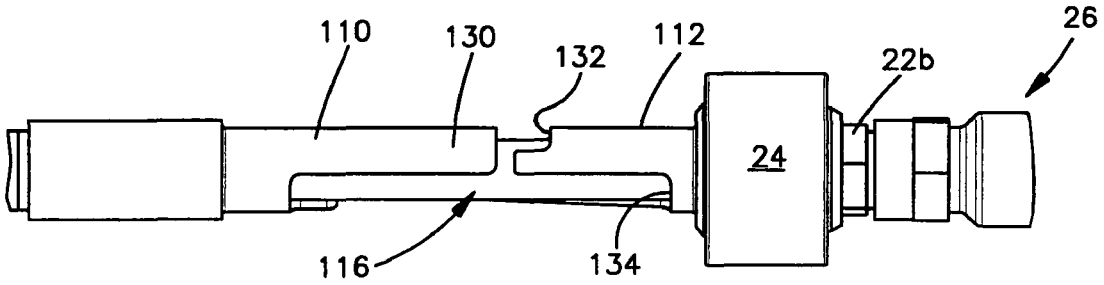
FIGS. 10A-10C illustrate the various operating positions of a detent mechanism forming part of the valve assembly shown in FIG. 1A.
Figure 10B:
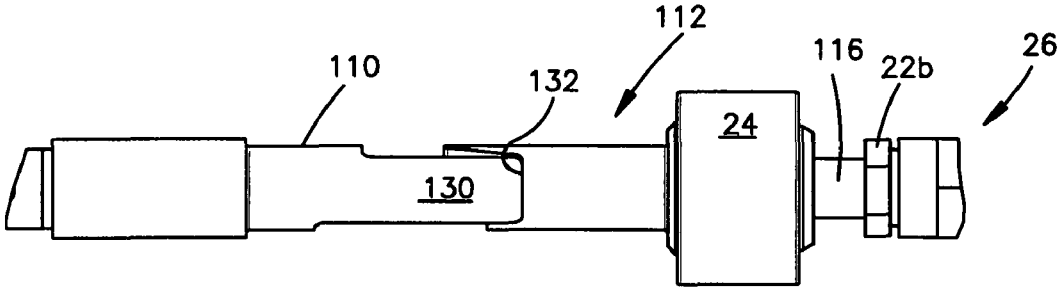
Figure 10C:
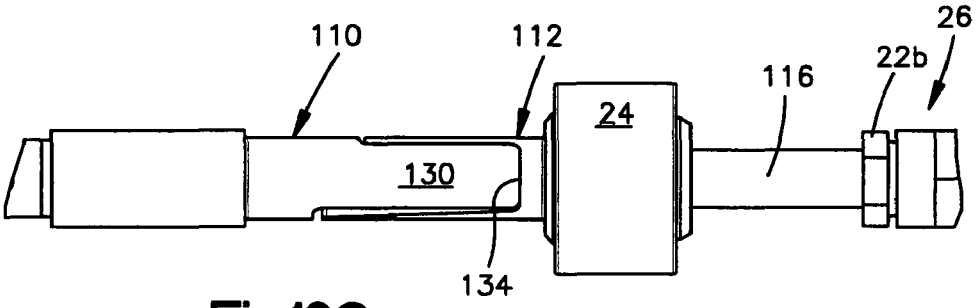

The finger and guide members define two different operating positions depending on the relative rotational positions of the finger member and the guide member (these positions are shown in FIGS. 10B and 10C). In one relative position, the application of air pressure moves the control spool 22*a* to the position shown in FIG. 3 whereas in another relative rotational position of the finger portions, the control spool 22*a* moves to the position shown in FIG. 4.

The relative position of the finger and guide members 110, 112 is changed by depressurizing the piercing tool 10 to allow the biasing spring 48 to move the control spool 22*a* to its extreme outer position (i.e., to a position that is spaced further from the bushing 24, thus disengaging and separating the finger and guide members forming part of the detent mechanism 30 (FIG. 10A). The conduit 26 is rotated in order to rotate the finger member 110 through a predetermined angle, i.e., 120° with respect to the guide member 112. The change in relative position of the finger and guide members changes the distance to which the control spool 22*a* is allowed to move towards the right (as viewed in FIGS. 3 and 4) when air pressure is restored.

Referring, in particular, to FIG. 1A, the valve assembly 22 includes a support shaft or valve stem 116 which defines a through passage 116*a* through which air under pressure is delivered from the conduit 26 (shown in FIGS. 10A-C) to the pressure chamber 25 (shown in FIG. 3). In the illustrated embodiment, the right end of the valve stem 116 (as viewed in FIG. 1A) includes a threaded segment 116d and threadedly receives a fitting or conduit adapter 22*b*. In the illustrated embodiment, the conduit 26 is connected to the stem 116 via the adapter 22*b*.

Figure 11:
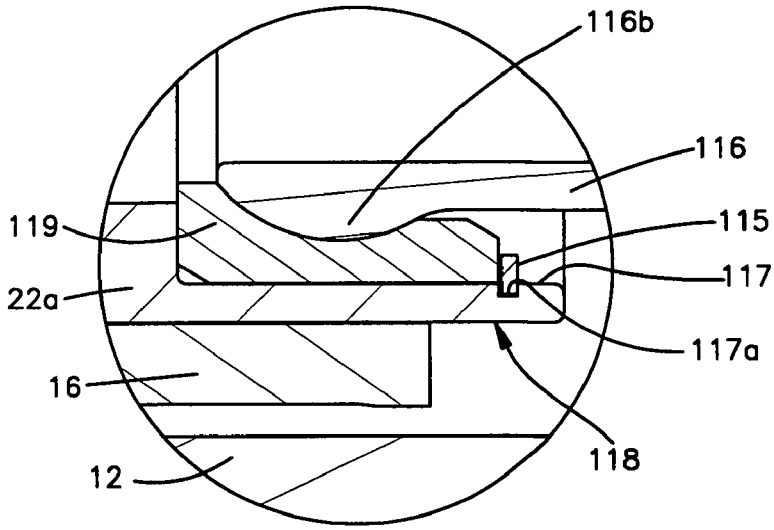
FIG. 11 is a fragmentary, sectional view of a spherical joint forming part of the present invention.

The control spool 22*a* is secured to the end of the support 116 via a spherical joint (indicated generally by the reference character 118) which includes a spherical shaped end 116*b* formed in the support shaft 116. Details of the spherical joint 118 are shown in FIG. 11. In particular, the spherical end 116*b* of the stem 116 is inserted into an elastomeric socket member 119. The stem 116 with the socket member 119 installed, is then inserted into a bore 117 forming part of the spool 22*a*. Once inserted, an internal snap ring 115 is installed which is received by a snap ring groove 117*a* formed in the bore 117. The snap ring 115 maintains the socket 119 and engaged spherical end 116*b* in the spool 22*a*.

Figure 12:
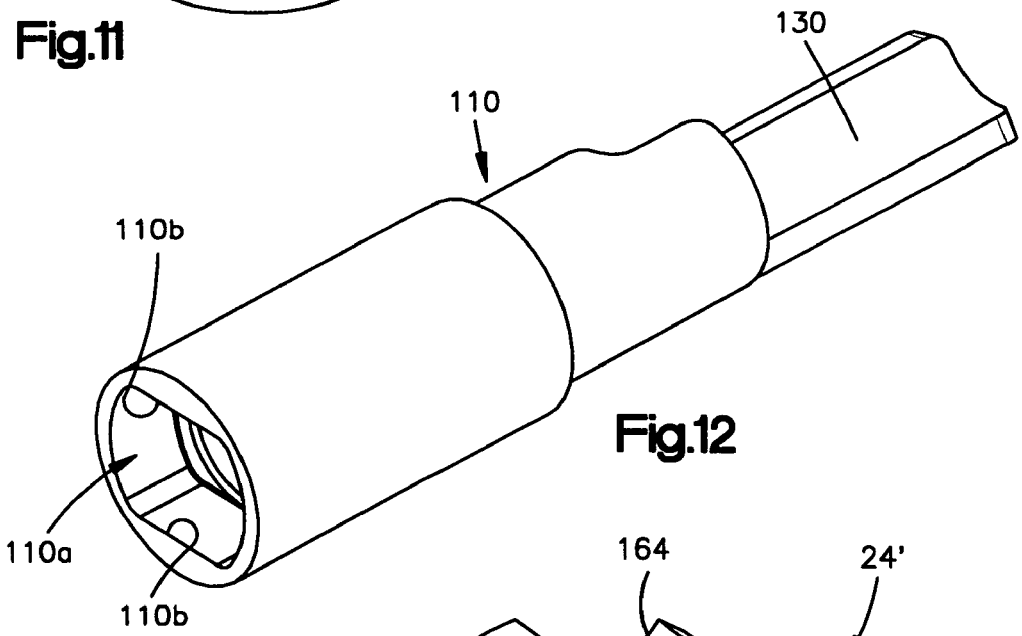
FIG. 12 is a perspective view of a finger member forming part of the present invention; and, FIG. 13 is a perspective view of an alternate embodiment of a bushing or shock absorber which may be used in the piercing tool shown in FIG. 1.

The finger member 110 is received by the support shaft and includes engagement structure to prevent relative rotation between the shaft 116 and the finger member 110. In the illustrated embodiment, the shaft or stem 116 (as seen best in FIG. 1A) includes a pair of flats 121 (only one flat is shown). Referring to FIG. 12, the finger member 110 includes an internal bore 110*a* that includes complementally shaped flat surfaces 110*b* that are engageable with the flats 121 formed on the valve stem 116.

The guide member 112 includes an enlarged, uniform diameter knurled portion 122 which is sized to be tightly received by a through bore 124 formed in the bushing 24. The engagement between the enlarged, uniform diameter knurled portion 122 with the bore 124 inhibits relative rotation between these two components.

The guide member 112 defines a through bore 126 which is sized to slidably receive a uniform diameter, tubular segment 116*c* of the support rod 116. Clearance is provided between the tubular segment 116*c* and the bore 126 to permit the support shaft 116 to both slide longitudinally and rotate with respect to the guide member 112. As seen best in FIG. 10A, the fitting/connector 22*b* secured to the right end of the valve stem 116 inhibits the valve stem 116 from being pulled through the guide member 112 to which the bushing 24 is mounted.

Referring now to FIGS. 10*a*-10*c*, the finger member 110 includes a longitudinally extending tongue portion 130. The guide member 112 defines two longitudinally spaced slot segments 132, 134, either of which are sized to receive the tongue 130.

As indicated above, the conduit fitting 22*b* is secured to the outer end of the support shaft or stem 116. With this construction, rotation of the supply conduit 26 (which is attached to the fitting 22*b*) produces rotation in the finger member 110 relative to the guide member 112. Rotating the finger member 110 with respect to the guide member 112 will cause the tongue 130 of the finger member to engage the slot 132 or the slot 134 depending on the direction of rotation and will thus determine whether the piercing tool 10 moves forward or backward.

FIG. 10A represents the positions the finger member 110 and the guide member 112 assume when the tool 10 is depressurized and the biasing spring 48 (not shown in FIGS. 10A-10C) acts to urge the members 110, 112 apart. FIG. 10B shows the relationship between the finger portion 110 and the guide member 112 when the tool is pressurized and in a forward mode. In this mode, the valve spool 22*a*, as seen in FIG. 3, is spaced further from the bushing 24 since the tongue 130 is engaging the slot 132.

In FIG. 10C, the tongue 130 is engaging the slot segment 134 which allows the control spool 22*a* to move to the position shown in FIG. 4, when the tool 10 is pressurized. As is apparent when comparing FIGS. 10B and 10C, the control spool 22*a* is substantially closer to the bushing 24 when the tongue 130 engages the slot segment 134. In this position, the tool 10 moves rearwardly.

Figure 13:
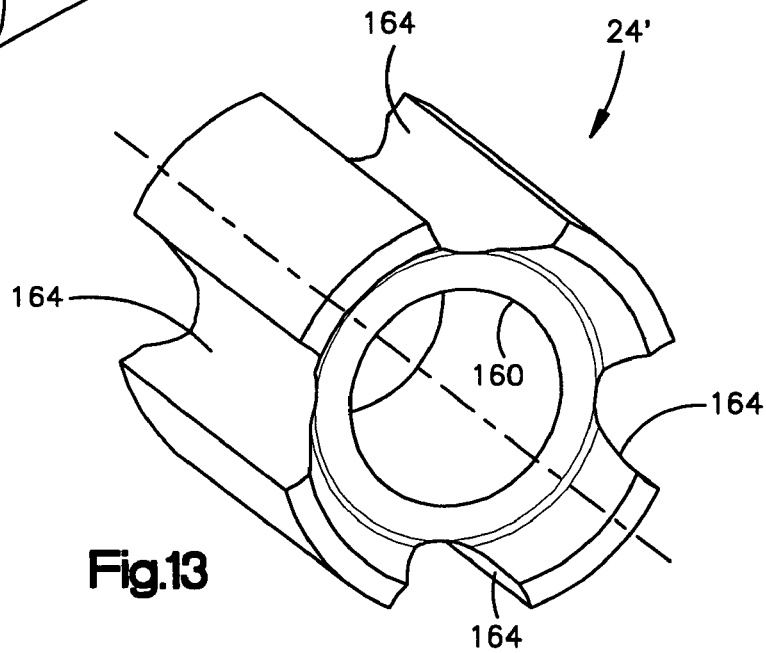

FIG. 13 illustrates an alternate construction for the exhaust bushing or shock absorber that is designated by the reference character 24 in FIGS. 1 and 1A. The alternate bushing 24' serves a similar function to that of the bushing 24 described earlier. The bushing 24' is also captured between the end cap 20 and the tail adapter 28 and is carried by the valve assembly 22. Unlike the construction of the bushing 24 shown in FIG. 1 (which includes a plurality of bores 24*a*), the bushing/shock absorber 24' includes a large central bore 160 for receiving the valve assembly 22 and a plurality of peripheral recesses or slots 164. The recesses are symmetrically spaced about the periphery of the bushing 24' and in the preferred embodiment, are somewhat arcuate in shape. In the illustrated embodiment, the bushing 24' includes four such recesses. These recesses 164 define air passages through which air is exhausted during the operation of the piercing tool. It has been found that the arcuate recesses or peripheral slots 164 provide less restriction to the flow of exhausting air as compared to the bores 24*a* of the bushing 24. The use of the arcuate recesses 164 does not detrimentally effect the performance of the bushing/shock absorber 24' as compared to the bushing 24 and it is believed that installation and replacement of the bushing 24' is more easily accomplished as compared to the bushing 24.

For a bushing/shock absorber 24' that has an overall outside diameter of 1.75 inches, four (4) arcuate recesses 164 each defined by a radius of 0.31 inches provide good results. It should be noted here that the invention contemplates other shapes for the peripheral recesses and the invention should not be limited to the arcuate shaped recesses shown in FIG. 13. In a preferred embodiment, the bushing/shock absorber 24' is molded from polyurethane having a durometer of approximately 92.

Although the invention has been described with a certain degree of particularity, it should be understood that those skilled in the art can make various changes to it without departing from the spirit or the scope of the invention as hereinafter claimed.

The invention claimed is:

1. A fluid pressure operated underground piercing tool, comprising:

a) an elongate cylindrical body having a striking element at one end;

b) a striker slidably received within a chamber defined by said cylindrical body;

c) an end cap threadedly engaged with another end of said body, said end cap capturing said striker within said body chamber;

d) a valve assembly for controlling the communication of pressurized fluid to said body and for controlling the discharge of pressurized fluid from said body, said valve assembly being operator adjustable in order to produce forward or rearward movement of said underground piercing tool; and e) said threaded engagement between said cylindrical body and said end cap being of a tapered buttress thread configuration and including a threaded segment formed on said cylindrical body and a complementally shaped threaded segment formed on said end cap and further including at least one substantial relieved section formed on one side of each of said threaded segments in order to reduce stress risers on the one side of each threaded segment.

2. The piercing tool of claim 1, wherein a female tapered thread is formed on another end of said cylindrical body and a complementally configured male tapered thread is formed on said end cap.

3. The piercing tool of claim 1, wherein the pressurized fluid for operating the tool is pressurized air.

4. The piercing tool of claim 1, wherein said striker defines at least one radial port that is oblong in shape and in which the long dimension of the port is parallel to an axis of, or centerline of the striker.

5. The piercing tool of claim 1, further comprising a tail adaptor coupled to said end cap, the coupling between said tail adaptor and said end cap being provided by the coengagement of tapered thread configurations formed on said end cap and tail adaptor.

6. The piercing tool of claim 5, further including an exhaust bushing for mounting said valve assembly in its operative position, said exhaust bushing being received by said end cap and maintained in its operative position by said tail adaptor.

7. The piercing tool of claim 6 wherein said exhaust bushing defines a plurality of peripheral recesses which provide a flow path for exhausting pressurized fluid.

8. The piercing tool of claim 7 wherein said exhaust bushing includes four recesses.

9. The piercing tool of claim 8 wherein each recess is arcuate in shape.

10. The piercing tool of claim 7 wherein said exhaust bushing is constructed from polyurethane having a durometer of approximately 92.

11. The piercing tool of claim 5, wherein said thread configurations formed on said tail adaptor and end cap are tapered buttress threads.

12. The piercing tool of claim 1 wherein said striking element is an anvil.

13. The piercing tool of claim 1, wherein said threaded engagement between said cylindrical body and said end cap is a buttress thread with a taper of substantially 1.5 inches per foot.

14. The piercing tool of claim 1, wherein said threaded engagement between said cylindrical body and said end cap is a 12 pitch American National Standard 7 deg./45 deg. buttress thread.

15. The piercing tool of claim 1 further including substantial relieved sections on another side of each threaded segment in order to reduce stress risers on the other side of each threaded segment.

16. A fluid pressure operated underground piercing tool, comprising:

a) an elongate cylindrical body having a striking element at one end;

b) a striker slidably received within a chamber defined by said cylindrical body;

c) an end cap threadedly engaged with another end of said body, said end cap capturing said striker within said body chamber;

d) a valve assembly for controlling the communication of pressurized fluid to said body and for controlling the discharge of pressurized fluid from said body, said valve assembly being operator adjustable in order to produce forward or rearward movement of said underground piercing tool; and e) said striker defining a plurality of annular balancing grooves which aid in the uniform distribution of pressurized fluid around the striker, whereby said striker is balanced and centered within said chamber.

17. The piercing tool of claim 16, wherein an end wall of said striker defines at least one recess which inhibits pressurized fluid from being trapped between the striker and said end cap when said striker is reciprocating within the body.

18. The piercing tool of claim 16, wherein the pressurized fluid for operating the tool is pressurized air.

19. The piercing tool of claim 16 wherein said striking element is an anvil.

20. A pneumatically operated underground piercing tool, comprising:

a) an elongate cylindrical body having striking element at one end;

b) a striker slidably received within a chamber defined by said cylindrical body;

c) an end cap threadedly engaged with another end of said body, said end cap capturing said striker within said body chamber;

d) a valve assembly for controlling the communication of pressurized air to said body and for controlling the discharge of pressurized air from said body, said valve assembly being operator adjustable in order to produce forward or rearward movement of said underground piercing tool; and, e) said threaded engagement between said cylindrical body and said end cap being of a tapered buttress thread configuration;

f) said striker defining a plurality of annular balancing grooves which aid in the uniform distribution of pressurized air around said striker, whereby said striker is balanced and centered within said chamber.

21. A fluid pressure operated underground piercing tool, comprising:

a) a cylindrical body;

b) a striker slidably received within a chamber defined by said cylindrical body;

c) a valve assembly for controlling the communication of pressurized fluid to said body and for controlling the discharge of pressurized fluid from said body, said valve assembly being operator adjustable in order to produce forward or rearward movement of said underground piercing tool;

d) said valve assembly including a detent mechanism comprising first and second relatively rotatable members and a control spool secured to an end of a spool support forming part of said valve assembly, said first and second members slidably received by said spool support;

e) said spool support defining structure engageable by complementally formed structure on one of said members, such that said engagement permits relative sliding movement between said spool support and said member while inhibiting relative rotation between said spool support and said member.

22. The piercing tool of claim 21 further including means for biasing said one member into engagement with said structure on said spool support.

23. The piercing tool of claim 22 wherein said means for biasing comprises a spring that urges said one member into operative engagement with said structure on said spool support.

24. The, apparatus of claim 21 wherein said structure formed on said spool support comprises at least one flat formed on an outside surface of said spool support and said complementally formed structure comprises a flat defined by an internal bore formed in said one member.

25. The piercing tool of claim 21 wherein one of said members comprises a finger member and other of said members comprises a guide member.

26. The piercing tool of claim 21 wherein said structure formed on said spool support comprises a pair of flats and said structure formed on said one member comprises complemental flats formed on an inside bore defined by said one member.

27. The piercing tool of claim 21 wherein said valve support includes a spherical end held in an elastomeric socket which is received by a bore defined by said control spool and said socket held in said control spool bore by a retaining element, said spherical joint permitting angular movement in said valve spool to facilitate alignment of said valve spool with a spool receiving bore defined in said striker.

28. A fluid pressure operated underground piercing tool, comprising:

a) an elongate cylindrical body having a striking element at one end;

a striker slidably received within a chamber defined by said cylindrical body;

c) a valve assembly for controlling the communication of pressurized fluid to said body and for controlling the discharge of pressurized fluid from said body, said valve assembly including a valve spool, a valve spool support and a socket structure for coupling said valve spool to said valve spool support, said socket structure comprising:

i) a spherical element formed on one end said of said spool support;

ii) an elastomeric socket adapted to receive said spherical element;

iii) a bore defined by said valve spool adapted to receive said socket; and, iv) a retaining element for maintaining said socket within said receiving bore defined by said spool.

29. The piercing tool of claim 28 wherein said retaining element comprises a snap ring, said coupling between said valve spool and said valve spool support permitting relative angular movement between said valve spool and said spool support.

30. A pneumatically operated underground piercing tool, comprising:

a) an elongate cylindrical body having striking element at one end;

b) a striker slidably received within a chamber defined by said cylindrical body;

c) an end cap threadedly engaged with another end of said body, said end cap capturing said striker within said body chamber;

d) a valve assembly for controlling the communication of pressurized air to said body and for controlling the discharge of pressurized air from said body, said valve assembly being operator adjustable in order to produce forward or rearward movement of said underground piercing tool;

e) said threaded engagement between said cylindrical body and said end cap being of a tapered buttress thread configuration and including a threaded segment formed on said cylindrical body and a complementally shaped threaded segment formed on said end cap and further including at least one substantial relieved section formed on one side of each of said threaded segments in order to reduce stress risers on one side of each threaded segment; and said striker defining a plurality of annular balancing grooves which aid in the uniform distribution of pressurized air around said striker, whereby said striker is balanced and centered within said chamber.

* * * * *